US009988993B2

(12) United States Patent
Nieddu et al.

(10) Patent No.: US 9,988,993 B2
(45) Date of Patent: Jun. 5, 2018

(54) FEED FORWARD TECHNIQUE AND APPLICATION FOR INJECTION PRESSURE CONTROL

(71) Applicant: GM GLOBAL TECHNOLOGY OPERATIONS LLC, Detroit, MI (US)

(72) Inventors: Stefano Nieddu, Turin (IT); Gennaro Merlino, Piemonte (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1210 days.

(21) Appl. No.: 14/026,904

(22) Filed: Sep. 13, 2013

(65) Prior Publication Data

US 2014/0081552 A1 Mar. 20, 2014

(30) Foreign Application Priority Data

Sep. 14, 2012 (GB) ..... 1216440.6

(51) Int. Cl.
*F02D 41/14* (2006.01)
*F02D 41/38* (2006.01)
*F02D 33/00* (2006.01)

(52) U.S. Cl.
CPC ..... *F02D 33/003* (2013.01); *F02D 41/1401* (2013.01); *F02D 41/3836* (2013.01); *F02D 2041/141* (2013.01); *F02D 2041/1409* (2013.01); *F02D 2041/1432* (2013.01); *F02D 2041/1433* (2013.01)

(58) Field of Classification Search
CPC ..... F02D 41/141; F02D 41/3836; F02D 41/1401; F02D 41/1433; F02D 41/1432; F02D 33/003; F02D 2041/1409
See application file for complete search history.

(56) References Cited

U.S. PATENT DOCUMENTS

| | | | | |
|---|---|---|---|---|
| 6,424,906 | B1 * | 7/2002 | Zhu | F02D 41/1401 700/34 |
| 7,232,506 | B2 * | 6/2007 | George | C23C 14/54 204/192.12 |
| 8,972,075 | B2 * | 3/2015 | Demirdelen | F02P 19/025 123/179.6 |
| 2003/0127082 | A1 | 7/2003 | Takahashi | |
| 2004/0231641 | A1 | 11/2004 | Wind | |
| 2006/0276956 | A1 | 12/2006 | Johnson | |
| 2012/0173002 | A1 * | 7/2012 | Zipplies | B01J 19/0033 700/8 |
| 2014/0081552 | A1 | 3/2014 | Nieddu et al. | |

FOREIGN PATENT DOCUMENTS

| | | | |
|---|---|---|---|
| EP | 1911954 | A1 | 4/2008 |
| GB | 2387242 | A | 10/2003 |
| WO | 2005042933 | A2 | 5/2005 |

OTHER PUBLICATIONS

Great Britain Patent Office, Great Britain Search Report for Great Britain Application No. GB1216440.6, dated Jan. 14, 2013.

* cited by examiner

*Primary Examiner* — Hieu T Vo
*Assistant Examiner* — Arnold Castro
(74) *Attorney, Agent, or Firm* — Lorenz & Kopf, LLP

(57) ABSTRACT

A control method is provided for using a feed forward technique. The method includes, but is not limited to using a setpoint value of a controlled variable to calculate a compensation of the closed loop static error, summing said contribution to the setpoint value, operating an estimation of the closed loop error to obtain a feed forward contribution.

9 Claims, 5 Drawing Sheets

FEED FORWARD TECHNIQUE AND APPLICATION FOR INJECTION PRESSURE CONTROL

CROSS-REFERENCE TO RELATED APPLICATION

This application claims priority to British Patent Application No. 1216440.6, filed Sep. 14, 2012, which is incorporated herein by reference in its entirety.

TECHNICAL FIELD

The technical field relates to a new feed forward technique for PI Based closed loop control enhancement. In particular, the new method can be widely applied in automotive field and, more particularly, for the injection pressure control of a fuel injection system for internal combustion engines, the method being actuated by an Electronic Control Unit of an automotive system.

BACKGROUND

It is known that modern internal combustion engines are provided with a fuel injection system for directly injecting the fuel into the cylinders of the engine. As an example, the so called Common Rail System (CRS) is the most used one for Diesel Engines. The CRS, generally, comprises a fuel pump, hydraulically connected to a fuel common rail and a plurality of electrically controlled fuel injectors, which are individually located in a respective cylinder of the engine and which are hydraulically connected to the fuel rail through dedicated injection pipes.

As also known, the injection pressure is one of the most important parameter determining the quality of the fuel injection into the engine (for example, the fuel spray penetration in the cylinder head) and must be regulated as function of the engine working conditions, for example, according to a map engine load vs. engine speed. A known technique used to control the injection pressure is a feed forward technique coupled with a proportional and integral (PI) closed loop control.

A problem of the actual pressure injection control and all controls using a standard feed forward technique is that the full compensation via feed-forward is not practicable, and therefore this implies the key role of the PI integrator as the only way to compensate the system unknowns and, consequently, to null the regulation error. On the other side: the system unknowns require a large span for the PI integrative and any saturation applied to the integrator output for anti-windup purposes should allow the regulation error cancellation; the need to filter the feed-forward makes heavier the PI integrative workload during transients: for a given slew-rate, stronger the filtering is higher the response overshoot is; the anti-windup technique could be ineffective during strong transients with high slew-rate: this could imply limitation on set-point dynamic and integrative gain.

Therefore a need exists for a new feed forward strategy that could overcome the above problems, let the PI integrator only acting on the compensation of system unknowns and tolerance. Therefore, at least one object is to provide a method of automatic control using a new feed forward technique, which coupled with a PI closed loop control, let to de-link the integrative gain $K_I$ from the overshoot requirements. At least another object is to provide an apparatus that allows performing the above method. In addition, other objects, desirable features and characteristics will become apparent from the subsequent summary and detailed description, and the appended claims, taken in conjunction with the accompanying drawings and this background.

SUMMARY

An embodiment of the disclosure provides a control method using a feed forward technique, the method comprising: using a setpoint value of a controlled variable to calculate a compensation of the closed loop static error, summing said contribution to the setpoint value, and operating an estimation of the closed loop error to obtain a feed forward contribution.

Consequently, a control apparatus is disclosed for performing a method of automatic control, the apparatus comprises a calculator for using a setpoint value of a controlled variable to calculate a compensation of the closed loop static error, a summer for summing said contribution to the setpoint value, and a device for operating an estimation of the closed loop error to obtain a feed forward contribution. An advantage of this embodiment is that the new feed-forward technique let to de-link the integrative gain KI from the overshoot requirements.

According to an embodiment, the method further comprises using a controlled variable error to calculate a load proportional contribution, and subtracting said feed forward contribution to the controlled variable error and calculating a load integral contribution.

Consequently, the control apparatus further comprises a calculator for calculating a load proportional contribution, by using a controlled variable error and a subtractor for subtracting said feed forward contribution to said controlled variable error and calculating a load integral contribution. An advantage of this embodiment is that the PI design results more easily since the dumped behavior is more practicable. The integrative gain could be very high and in principle will be limited only by stability constraint.

According to another aspect, the method further comprises: summing said load proportional and a load integral contributions to an estimation of the system load, and applying the previous sum to the actual system plant.

Consequently, the control apparatus further comprises a summer for summing said load proportional and said load integral contributions to an estimated load and means for applying the previous sum to the actual system plant. An advantage of this aspect is to take into account all the plant environment with respect to the controlled variable.

According to another embodiment, the method controls an injection pressure of a fuel injection system according to the previous embodiment, wherein the injection pressure corresponds to the controlled variable, the flow rate corresponds to the load, the plant transfer function can be expressed as $\Delta p \sim \int(Q_{in}-Q_{out})$. An advantage of this embodiment is that the integrative operating range is de-linked from overshoot limitation, the maximum overshoot is limited and can be set to a value close to zero and it is possible to remove any limitation on pressure set-point slew-rate up to the ideal step response.

The method according to one of its aspects can be carried out with the help of a computer program comprising a program-code for carrying out all the steps of the method described above, and in the form of computer program product comprising the computer program.

The computer program product can be embodied as a control apparatus for an internal combustion engine, comprising an Electronic Control Unit (ECU), a data carrier associated to the ECU, and the computer program stored in a data carrier, so that the control apparatus defines the embodiments described in the same way as the method. In this case, when the control apparatus executes the computer program all the steps of the method described above are carried out. The method according to a further embodiment can be also embodied as an electromagnetic signal, said signal being modulated to carry a sequence of data bits which represents a computer program to carry out all steps of the method.

A still further embodiment of the disclosure provides an internal combustion engine specially arranged for carrying out the method claimed.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Even if the new feed forward technique has a wide application possibilities, one of the technical field where it can be advantageously used is the automotive one, to improve some control strategies, like as an example the injection pressure control of a fuel injection system. Therefore the detailed description will start with a general description of an automotive system, will follow with the detailed description of the new control technique and its related control apparatus and will end with a practical application of such technique to improve the control of the injection pressure.

Figure 1:
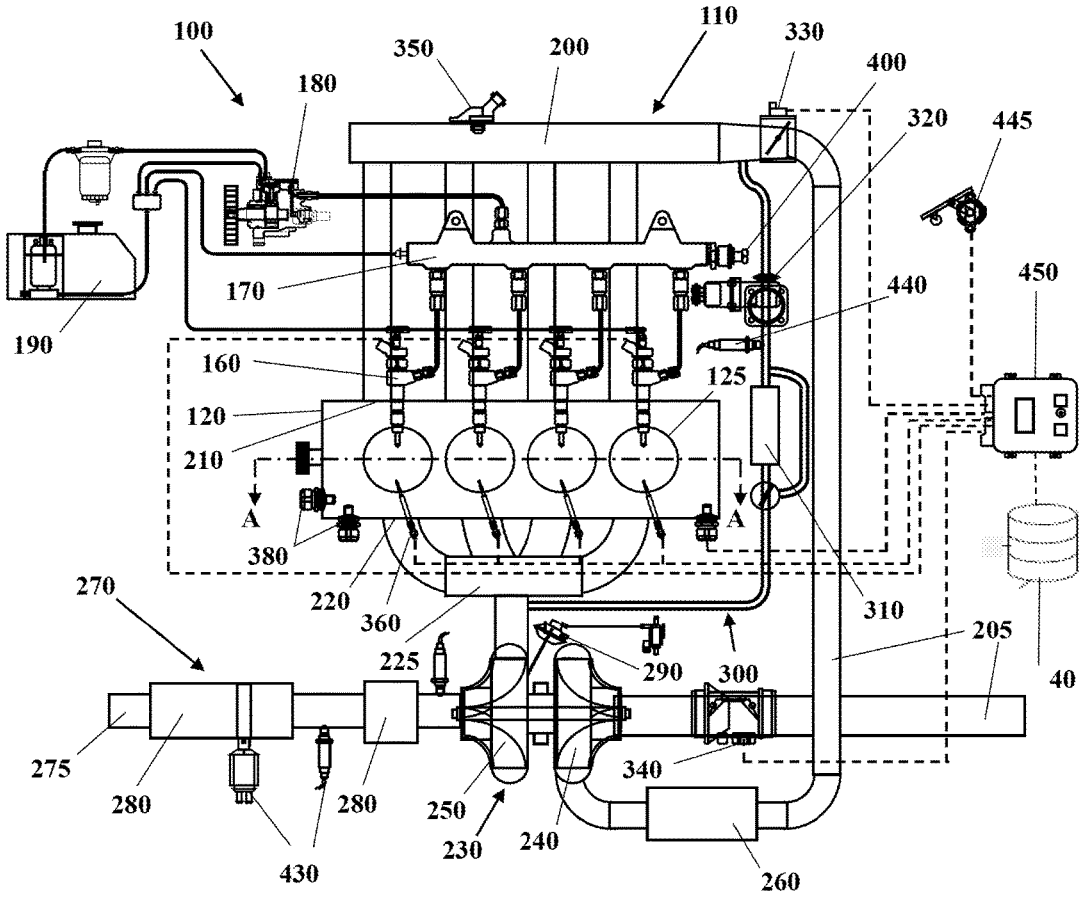
FIG. 1 shows an automotive system.
Figure 2:
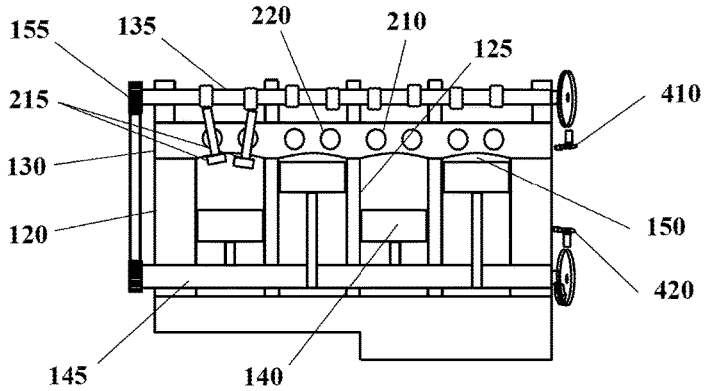
FIG. 2 is a section of an internal combustion engine belonging to the automotive system of FIG. 1.

Some embodiments may include an automotive system 100, as shown in FIG. 1 and FIG. 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150.

A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. The fuel injection system with the above disclosed components is known as Common Rail Diesel Injection System (CR System). It is a relative new injection system for passenger cars. The main advantage of this injection system, compared to others, is that due to the high pressure in the system and the electromagnetically controlled injectors it is possible to inject the correct amounts of fuel at exactly the right moment. This implies lower fuel consumption and less emissions.

Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after treatment devices 280. The after treatment devices may be any device configured to change the composition of the exhaust gases. Some examples of after treatment devices 280 include, but are not limited to, catalytic converters (two and three way), oxidation catalysts, lean NOx traps, hydrocarbon absorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110 and equipped with a data carrier 40. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system, and send and receive signals to/from the interface bus. The memory system may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

Figure 3:
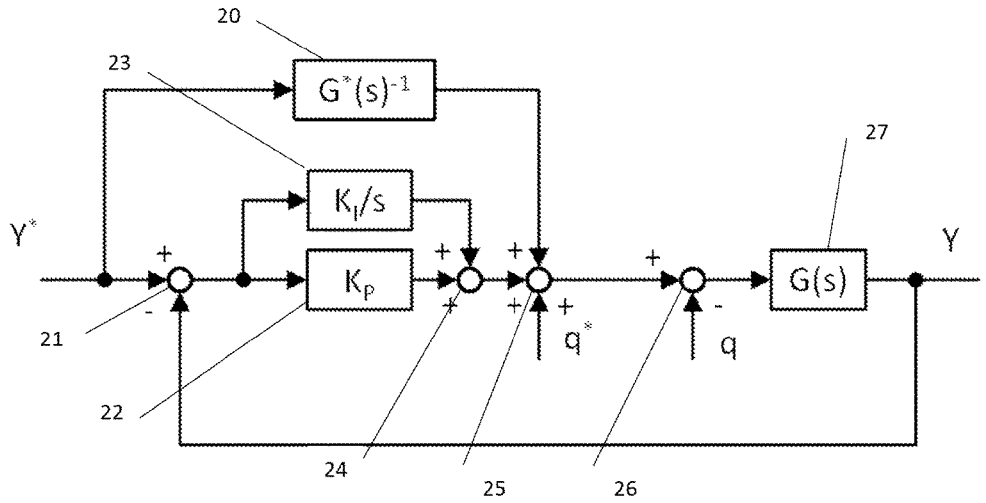
FIG. 3 is the block diagram of a known feed-forward application on PI regulated systems.

To explain the new feed forward technique, some background information has to be provided. In FIG. 3 a simple sketch of a PI regulation is indicated, where G(s) is the actual transfer function of the plant, G*(s) is the transfer function of the plant model. The feed-forward technique is applied directly into the plant by mean of the transfer function $G^*(s)^{-1}$ and the load estimation q*.

The relationship between the set-point Y* and the output Y is reported by the following:

$$Y = \frac{[s/(K_I G^*(s)) + sK_P/K_I + 1]}{[s/(K_I G(s)) + sK_P/K_I + 1]} \cdot Y^* - \frac{s/K_I}{[s/(K_I G(s)) + sK_P/K_I + 1]} \cdot (q^* - q)$$

Where, other already defined variables: $K_P$ is the proportional coefficient and $K_I$ is the integral coefficient.

Observing the equation can be stated that from a merely mathematical point of view it is possible to fully compensate the physical system if the plant transfer-function G(s) and the load q are well known. In fact, supposing to have the estimated functions equal to the actual ones: G*(s)=G(s); q*=q; and it follows that Y=Y*.

In practice, following the block diagram in FIG. 3, the setpoint value Y* is used to calculate 20 a load feed forward contribution. Then, the controlled variable error (Y*−Y) is calculated 21 and used to calculate 22 a load proportional contribution and 23 a load integral contribution, which are summed 24 and then summed 25 to the load feed forward contribution and to the estimated load q*. Finally the calculated load is applied to the actual system, the difference 26 between the calculated load and the actual physical load q takes effect on the actual plant transfer function 27, and the actual value Y of the controlled variable is so determined.

Actually the full compensation via feed-forward is not practicable, the reasons are different but in particular the followings can be considered: the plant model is in general a strong approximation of the reality, that means a fully compensation via feed-forward is a challenge. That is evident if we take into account the additional singularities, not linearity and tolerance introduced by sensors and actuators. Therefore the model G*(s) is representative of the plant behavior only for the low frequency range and sometimes only for the small signal variations; in general the set-point Y* is affected by high-frequency noise that is magnified by $G^*(s)^{-1}$. The magnification of the high frequency contents can introduce saturations and distortion on sensors and actuators so that the system can lose its linearity and regulation performance. The only way to avoid such kind of problems is to add a proper low-pass filtering on the transfer function $G^*(s)^{-1}$. As consequence the target of full compensation cannot be reached; in general, the load q is affected by relevant tolerance, its compensation q* could refer only to the nominal case.

The limited effectiveness of the feed-forward technique implies the key role of the PI integrator as the only way to compensate the system unknowns and, consequently, to null the regulation error. In particular can be observed that: the system unknowns and, in particular, the load tolerance require a large span for the PI integrative, any saturation applied to the integrator output for anti-windup purposes should allow the regulation error cancellation; the need to filter the feed-forward makes heavier the PI integrative workload during transients: for a given slew-rate, stronger the filtering is higher the response overshoot is; the anti-windup technique could be ineffective during strong transients with high slew-rate: this could imply limitation on set-point dynamic and integrative gain.

Figure 4:
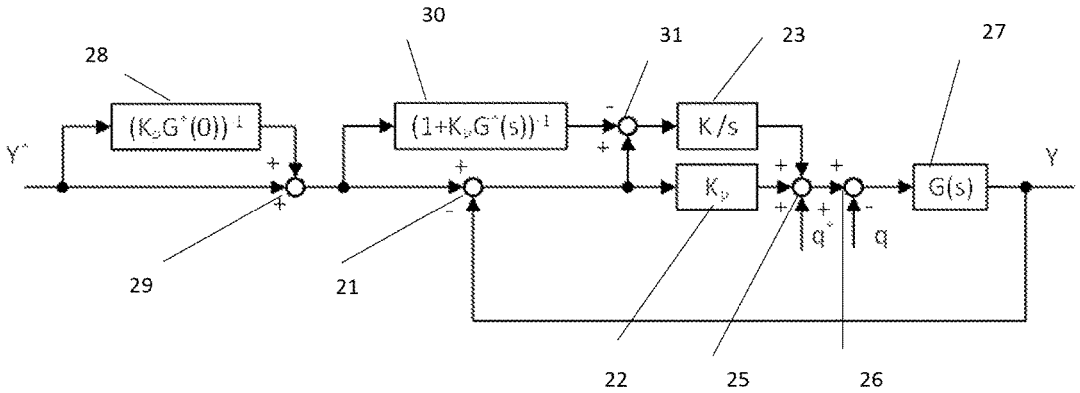
FIG. 4 is a block diagram of a new feed-forward technique applied to PI regulated systems, according to an embodiment.

The new feed-forward technique aims to solve the limitation described before so that the integrative exploitation can be maximized avoiding any overshoot also in the step response transient, the method and its related apparatus are reported in FIG. 4. The relationship between the set-point Y* and the output Y is the following, where G*(0) is the static value of the plant model transfer function:

$$Y = \frac{[s/(K_I G^*(s)) + sK_P/K_I + 1]}{[s/(K_I G(s)) + sK_P/K_I + 1]} \cdot \frac{K_P G^*(s)}{(1 + K_P G^*(s))} \cdot \frac{(1 + K_P G^*(0))}{K_P G^*(0)} \cdot Y^* - \frac{s/K_I}{[s/(K_I G(s)) + sK_P/K_I + 1]} \cdot (q^* - q)$$

Supposing to have an estimation of the plant equal to the actual one G*(s)=G(s), q*=q, will result in:

$$Y = \frac{K_P G^*(s)}{(1 + K_P G^*(s))} \cdot \frac{(1 + K_P G^*(0))}{K_P G^*(0)} \cdot Y^*$$

Differently from the previous feed-forward technique the system is not fully compensated, moreover the closed loop control behavior is equivalent to a pure proportional control with compensation of the static error. In practice, following the block diagram in FIG. 4, the load feed forward contribution is determined as follows: the setpoint value Y* is used to calculate 28 a compensation of the closed loop static error, then the sum 29 of this contribution and the setpoint value operating with the block 30 gives an estimation of the closed loop error. Then, the controlled variable error (Y*−Y) is calculated 21 and used to calculate 22 a load proportional contribution; the same error is reduced 31 by the feed forward contribution and then is used to calculate 23 a load integral contribution. The load proportional and integral contributions and the estimated load q* are summed 25. Finally the calculated load is applied to the actual system, the difference 26 between the calculated load and the actual physical load q takes effect on the actual plant transfer function 27 and the actual value Y of the controlled variable is so determined.

Consequently, the related apparatus comprises a calculator for calculating 28 the compensation of the closed loop static error, by using the setpoint value Y*, a summer for summing 29 this contribution and the setpoint value and an estimator for estimating 30 the closed loop error. Further, the apparatus comprises a calculator for calculating 21 the controlled variable error (Y*−Y) and calculating 22 a load proportional contribution; a calculator for calculating 23 a load integral contribution by using the difference 31 between the variable error and the feed forward contribution; a summer for summing 25 the load proportional and integral contributions and the estimated load q*; a calculator for calculating the difference 26 between the calculated load and the actual physical load q and then 27 the actual plant transfer function.

Apparently the new technique is less performing but its practical application is more convenient for the following reasons: the magnitude of $(1+K_P \cdot G^*(s))^{-1}$ at high frequency is in general unitary, moreover the feed-forward is applied to PI integrator input that guarantee a good filtering action for the high frequency noise affecting the set-point Y*; the closed loop behavior equivalent to a pure proportional control let to have fully dumped response in case of zero, first order and second order systems; if the plant model G*(s) is close to G(s) the integrative part of PI doesn't contribute to a possible overshoot, this let to increase the integrative gain $K_I$ up to the maximum limit imposed by the system stability; the PI integrative doesn't need any limitation for anti-windup purposes; the possibility to choose a high value for $K_I$ let to speed-up the recovery of system unknowns and load tolerance, this advantage is particularly relevant if they vary with the system operating point.

A comparison between the old and the new feed forward technique will be shown, for first and second order system. Suppose to have a first-order system with the following transfer function:

$$G(s) = \frac{G_0}{(1 + s\tau)}$$

Where τ is the time constant of the system. Then, let's assume that the proportional gain $K_P$ has been properly chosen as value so that the dominant pole of the closed-loop will have the following time-constant in case of proportional regulator application only ($\tau_P$, proportional time constant):

$$\tau_P = \frac{\tau}{K_P G_0 + 1}$$

The two feed-forward techniques applications will be compared assuming that for the known feed-forward technique G*(s) is the reciprocal of the plant model plus a high frequency filtering ($\tau_F$, filtering time constant):

$$G^*(s)^{-1} = \frac{1}{G_0} \cdot \frac{(1 + s\tau)}{(1 + s\tau_F)}$$

Where $\tau_F$ is properly chosen in order to limit the effect of the set-point noise, let's suppose as an example, that is $\tau_F = \tau_P$.

For the new feed-forward technique let's assume that G*(s) is the plant model. The high-frequency noise affecting the set-point Y* results already attenuated by the PI integrator, therefore the feed-forward application doesn't need any filter, it follows that:

$$(1 + K_P G^*(s))^{-1} = \frac{1}{(1 + K_P G_0)} \cdot \frac{(1 + s\tau)}{\left[\frac{s\tau}{(1 + K_P G_0)} + 1\right]}$$

Figure 5:
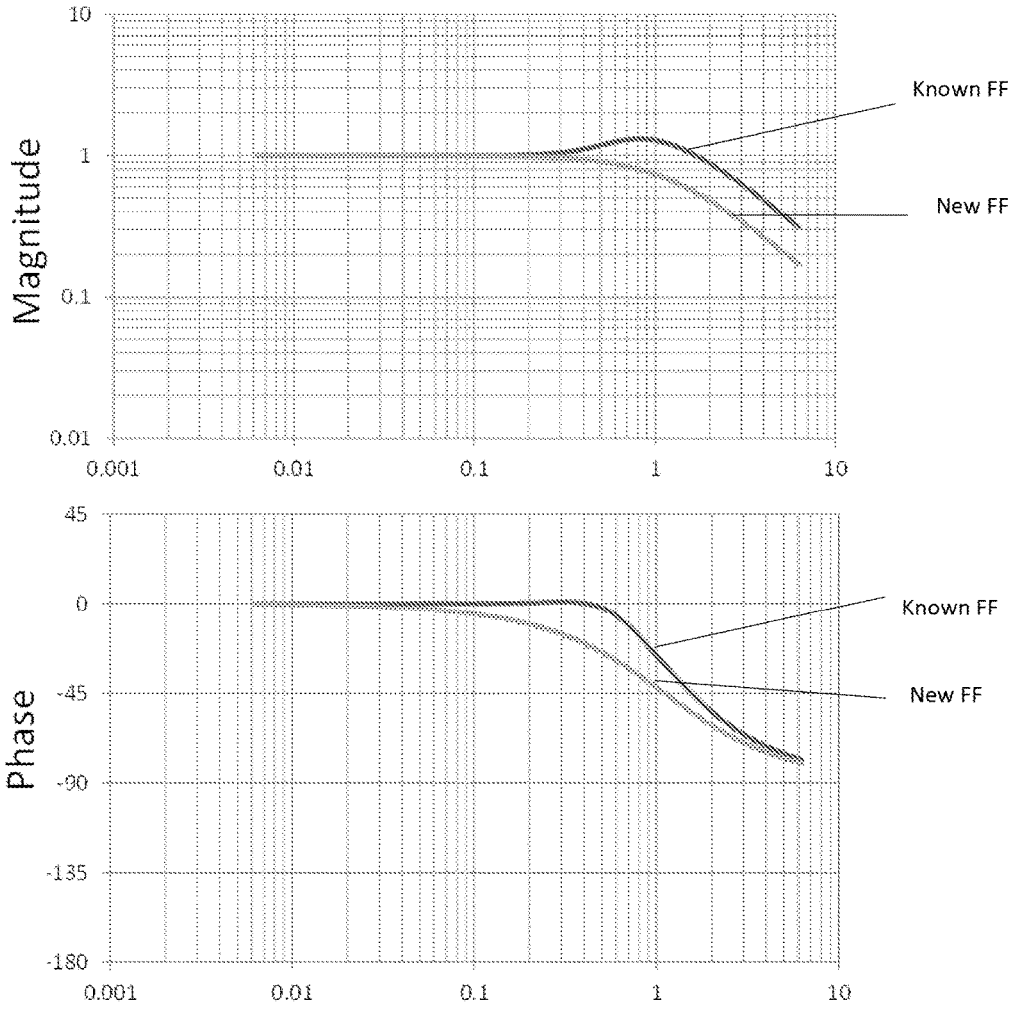
FIG. 5 is a graph depicting the comparison between known and new feed forward technique in terms of magnitude and phase for a first order system regulated in closed loop via PI.

In FIG. 5 there are reported the bode diagrams for two cases, the PI integrative gain has been set to obtain a PI zero equals to $2\tau_P$. It can be noticed how the new feed-forward technique maintains the closed-loop response perfectly dumped and equivalent to a pure proportional closed-loop control. Now let's move to a second order system and suppose to have the following transfer function:

$$G(s) = \frac{G_0}{s \cdot (1 + s\tau)}$$

Then let's assume to set the gain $K_P$ in order to obtain two dominant poles real and coincident in case of proportional regulator application only:

$$K_P = \frac{1}{4\tau \cdot G_0}$$

Results that $\tau_{P1,2} = 2\tau$

Where $\tau_{P1,2}$ is the time constant of the two dominant poles.

The two feed-forward techniques applications will be compared assuming that for the known feed-forward technique $G^*(s)^{-1}$ is the reciprocal of the plant model plus an high frequency filtering:

$$G^*(s)^{-1} = \frac{1}{G_0} \cdot \frac{s \cdot (1 + s\tau)}{(1 + s\tau_F)^2}$$

Where $\tau_F$ is properly chosen in order to limit the effect of the set-point noise, for example let's assume that is $\tau_F = \tau_{P1,2}$. For the new feed-forward technique let's assume that G*(s) is the plant mode, therefore it follows that:

$$(1 + K_P G^*(s))^{-1} = \frac{s \cdot (1 + s\tau)}{[s \cdot (1 + s\tau) + K_P G_0]}$$

Figure 6:
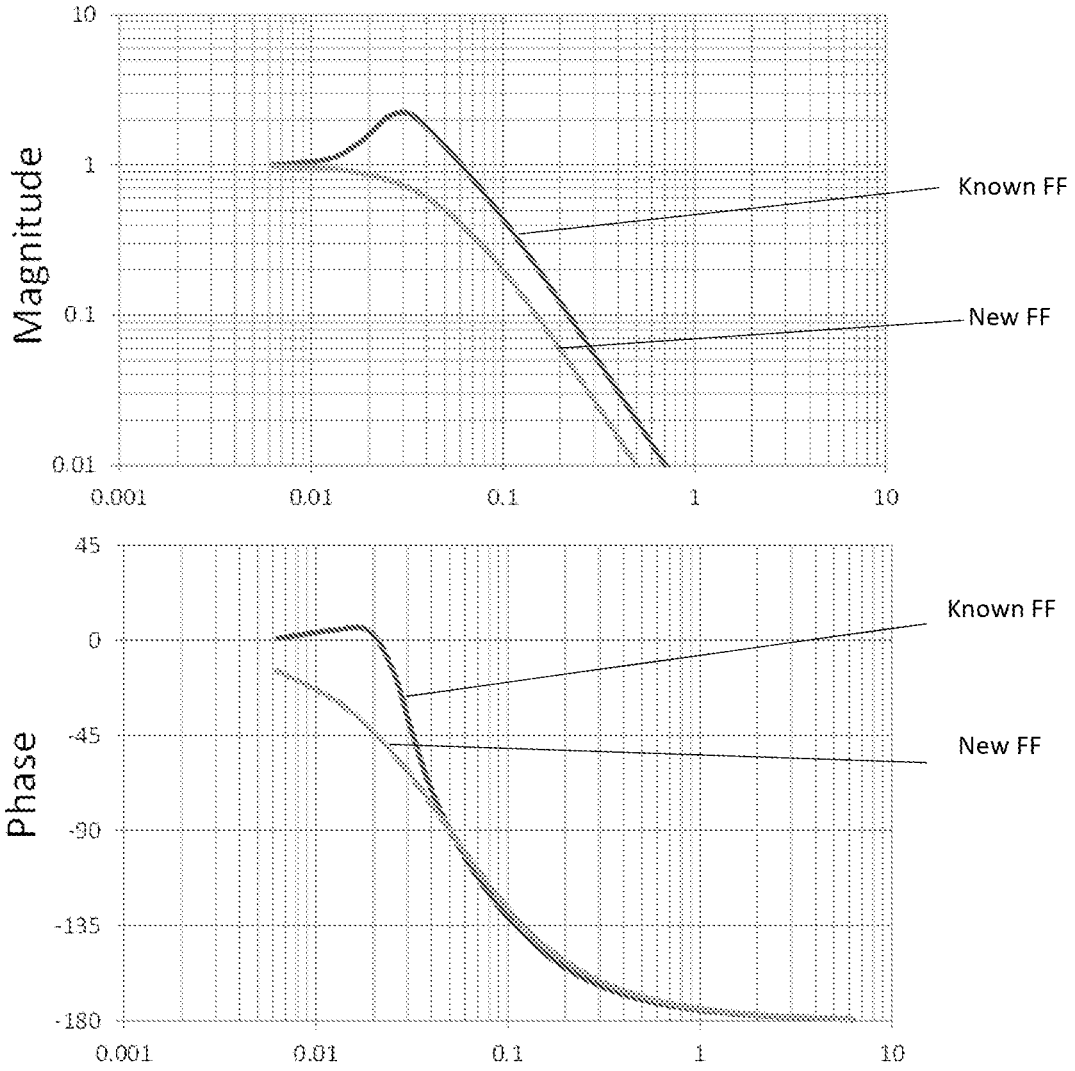
FIG. 6 is a graph depicting the comparison between known and new feed forward technique in terms of magnitude and phase for a second order system regulated in closed loop via PI.

In FIG. 6 there are reported the bode diagrams for two cases, the PI integrative gain has been set to obtain a PI zero equals to $2\tau_{P1,2}$. It can be noticed how the new feed-forward technique maintains the closed-loop response perfectly dumped even with a very high gain for the integrative of PI. Summarizing the new feed-forward technique let to de-link the integrative gain $K_I$ from the overshoot requirements, the PI design results more easier since the dumped behavior is now more practicable. The integrative gain could be very high and in principle will be limited only by stability constraint; this is a strong advantage for the fast recovery of system load variation. The noise affecting the input set-point is not amplified by the feed-forward path; this means no additional filtering is needed for the feed-forward.

As anticipated, a practical application of the new feed forward technique is the injection pressure regulation in a Common Rail System. The pressure in the system, generally in the common rail is determined by a fuel quantity balance between the high pressure pump flow ($Q_{in}$) and the flow towards the injectors and an eventual pressure regulating valve ($Q_{out}$). Actually the pressure regulation follows a control scheme as the one in FIG. 3 with the pressure p as controlled variable Y, the fuel quantity $Q_{in}$ as the sum between the proportional load, the integral load, the feed-forward load and the estimation of the system load q* and the fuel quantity $Q_{out}$ as the actual system load q. The transfer function G represents the integral of the quantity balance with $\Delta p \sim \int(Q_{in}-Q_{out})\cdot dt$.

Figure 7:
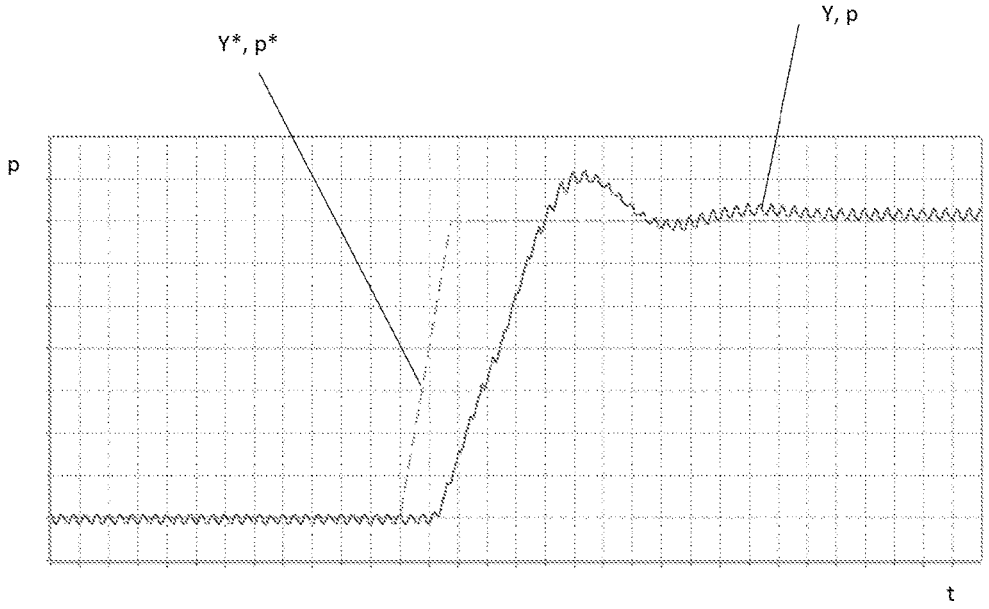
FIG. 7 is a graph depicting the controlled variable behavior by using the known feed forward technique.

The pressure regulation is very sensitive if controlled with the known feed forward technique. In particular, during fast pressure ramps its control is characterized by a typical pressure overshoot, due to the integrative part of PI used to regulate the pressure in closed loop, as can be seen in FIG. 7, where Y, p is the controlled variable and Y*, p* the setpoint value of the controlled variable. Differently from common usage of PI regulator for first-order system, the anti-windup technique limiting the integrator span cannot be properly applied, because of the large spread of injector leakages that require a large operating range for the integrative itself. The main problems due to this limitation are: the PI integrative sustains the pressure regulation during ramps. It slowly discharges at the ramp end and this causes high pressure overshoots and, consequently, the risk to open the overpressure valve; the maximum pressure set-point is limited because the overpressure margin has to be taken into account, thus limiting combustion calibration; the pressure set-point slew-rate is also limited to mitigate the overpressure dangerous effects and this implies limitation on combustion calibration during high engine loads.

Figure 8:
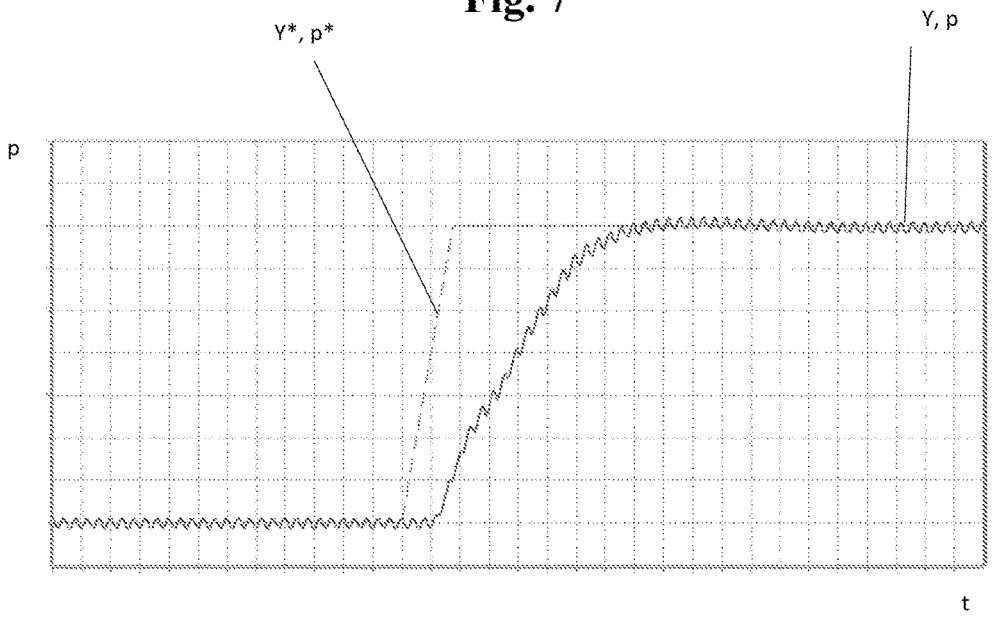
FIG. 8 is a graph depicting the controlled variable behavior by using the new feed forward technique.

By using the new feed forward technique, as in the block diagram of FIG. 4 and with the same assumptions: the pressure p as controlled variable Y the fuel quantity $Q_{in}$ as the sum between the proportional load, the integral load and the estimation of the system load q*, the fuel quantities $Q_{out}$ as the actual system load q, the transfer function G represents the integral of the quantity balance with $\Delta p \sim \int(Q_{in}-Q_{out})\cdot dt$, the following results will be achieved: the PI integrator operates only to compensate the error due to the unknowns and tolerance, while the ramp regulation is sustained by proportional gain $K_P$. In FIG. 8, where Y, p is the controlled variable and Y*, p* the setpoint value of the controlled variable, it can be seen that the response is fully dumped and characterized by a typical delay proportional to $1/K_P$. Consequently, the following benefits will be achieved: the integrative operating range is de-linked from overshoot limitation; the maximum overshoot is limited and can be set to a value close to zero (full dumping); it is possible to remove any limitation on pressure setpoint slew-rate up to the ideal step response; it is possible to compensate the typical delay proportional to $1/K_P$ by applying a further feed-forward term calculated from the set-point slew-rate. A proper saturation applied to this feed-forward term will limit the maximum overshoot inherent this additional technique.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents.

What is claimed is:

1. A control method for an operating parameter in an actual system plant using a feed forward technique, the control method comprising:

computing a closed loop static error compensation using a setpoint value for the operating parameter and a transfer function representative of the actual plant system;

computing a compensated setpoint value by adding the closed loop static error compensation and the setpoint value;

determining an actual value of the operating parameter from a sensor monitoring the actual system plant;

computing a controlled variable error by subtracting the actual value from the compensated setpoint value;

estimating a closed loop error of the compensated setpoint value;

computing a feed forward load contribution based on the controlled variable error and the estimated closed loop error;

computing a calculated load by adding the feed forward load contribution to an estimated load of the actual system plant;

computing an adjusted load by subtracting a measured load of the actual system plant from the calculated load; and controlling the operating parameter based on the adjusted load.

2. The control method according to claim 1, wherein the feed forward load contribution comprises a summation of a load integral contribution and a load proportional contribution, the control method further comprising:

computing the load integral contribution as a function of a difference between the controlled variable error and the estimated closed loop error; and computing the load proportion contribution as a function of the controlled variable error.

3. The control method according to claim 1, wherein the actual plant system comprises a fuel injection system having a fuel rail and wherein:

a fuel injection pressure (p) corresponds to the operating parameter;

a fuel quantity entering the fuel the fuel rail ($Q_{in}$) corresponds to the calculated load;

a fuel quantity exiting the fuel rail ($Q_{out}$) corresponds to the measured load; and an integral of the quantity balance as follows:

$$\Delta p \sim \int(Q_{in}-Q_{out})dt$$

corresponds to the transfer function.

4. A control apparatus for controlling an operating parameter of an actual system plant using a feed forward technique, the control apparatus comprising:

a sensor configured to measure the operating parameter;

an actuator configured to control the operating parameter; and an electronic control unit in communication with the sensor and controlling the actual plant system, wherein the electronic control unit is configured to:

compute a closed loop static error compensation using a setpoint value for the operating parameter and a transfer function representative of the actual plant system;

compute a compensated setpoint value by adding the closed loop static error compensation and the setpoint value;

determine an actual value of the operating parameter measured by the sensor;

compute a controlled variable error by subtracting the actual value from the compensated setpoint value;

estimate a closed loop error of the compensated setpoint value;

compute a feed forward load contribution based on the controlled variable error and the estimated closed loop error;

compute a calculated load by adding the feed forward load contribution to an estimated load of the actual system plant;

compute an adjusted load by subtracting a measured load of the actual system plant from the calculated load; and control the actuator for adjusting the operating parameter based on the adjusted load.

5. The control apparatus according to claim 4, wherein the feed forward load contribution comprises a summation of a load integral contribution and a load proportional contribution, the electronic control unit is further configured to:

compute the load integral contribution as a function of a difference between the controlled variable error and the estimated closed loop error; and compute the load proportion contribution as a function of the controlled variable error.

6. The control apparatus according to claim 4, wherein the actual plant system comprises a fuel injection system having a fuel rail and wherein:

a fuel injection pressure (p) corresponds to the controlled variable;

a fuel quantity entering the fuel the fuel rail ($Q_{in}$) corresponds to the calculated load;

a fuel quantity exiting the fuel rail ($Q_{out}$) corresponds to the measured load; and an integral of the quantity balance as follows:

$$\Delta p \sim \int (Q_{in} - Q_{out}) dt$$

corresponds to the transfer function.

7. A non-transitory computer readable medium comprising processor-executable instructions for reading data from a processor in communication with at least one sensor configured to measure an operating parameter of an actual system plant, the processor-executable instructions when executed on the processor in a control apparatus configure the control apparatus to:

compute a closed loop static error compensation using a setpoint value for the operating parameter and a transfer function representative of the actual plant system;

compute a compensated setpoint value by adding the closed loop static error compensation and the setpoint value;

determine an actual value of the operating parameter measured by the sensor;

compute a controlled variable error by subtracting the actual value from the compensated setpoint value;

estimate a closed loop error of the compensated setpoint value;

compute a feed forward load contribution based on the controlled variable error and the estimated closed loop error;

compute a calculated load by adding the feed forward load contribution to an estimated load of the actual system plant;

compute an adjusted load by subtracting a measured load of the actual system plant from the calculated load; and control the operating parameter based on using the adjusted load.

8. The non-transitory computer readable medium according to claim 7, wherein the feed forward load contribution comprises a summation of a load integral contribution and a load proportional contribution, and the processor-executable instruction when executed on the processor configured the control apparatus to compute the load integral contribution as a function of a difference between the controlled variable error and the estimated closed loop error; and compute the load proportion contribution as a function of the controlled variable error.

9. The non-transitory computer readable medium according to claim 7, wherein the actual plant system comprises a fuel injection system having a fuel rail and wherein:

a fuel injection pressure (p) corresponds to the controlled variable;

a fuel quantity entering the fuel the fuel rail (Qin) corresponds to the calculated load;

a fuel quantity exiting the fuel rail (Qout) corresponds to the measured load; and an integral of the quantity balance as follows:

$$\Delta p \sim \int (Q_{in} - Q_{out}) dt$$

corresponds to the transfer function.

* * * * *